US008225572B2

(12) United States Patent
Wallace

(10) Patent No.: US 8,225,572 B2
(45) Date of Patent: Jul. 24, 2012

(54) WALL PANEL ASSEMBLY

(75) Inventor: Michael R. Wallace, Maple Grove, MN (US)

(73) Assignee: Sagamore Partners, LLC, Rogers, MN (US)

( * ) Notice: Subject to any disclaimer, the term of this patent is extended or adjusted under 35 U.S.C. 154(b) by 339 days.

(21) Appl. No.: 12/564,256

(22) Filed: Sep. 22, 2009

(65) Prior Publication Data

US 2011/0067338 A1 Mar. 24, 2011

(51) Int. Cl.
*E04B 1/38* (2006.01)

(52) U.S. Cl. ..... 52/512; 52/506.05; 52/509; 52/511; 52/710; 52/235

(58) Field of Classification Search ..... 52/506.01, 52/521, 506.05, 509, 511, 545, 547, 549, 52/385, 235, 510, 712, 710, 846; 248/205.1; 24/289, 293, 294, 295, 296, 297, 457, 458
See application file for complete search history.

(56) References Cited

U.S. PATENT DOCUMENTS

| | | | | | |
|---|---|---|---|---|---|
| 2,073,795 | A * | 3/1937 | Haugaard | 52/385 |
| 2,082,241 | A * | 6/1937 | Bennett | 52/387 |
| 2,317,015 | A * | 4/1943 | Allen | 52/512 |
| 2,377,211 | A * | 5/1945 | Cocken, Jr. | 404/40 |
| 4,601,247 | A * | 7/1986 | Welch et al. | 108/152 |
| 5,479,752 | A * | 1/1996 | Menegoli | 52/549 |
| 5,490,359 | A * | 2/1996 | Hepler | 52/506.06 |
| 5,791,093 | A * | 8/1998 | Diamond | 52/36.5 |
| 6,631,589 | B1 * | 10/2003 | Friedman et al. | 52/30 |
| 7,587,869 | B2 * | 9/2009 | Lahni | 52/235 |
| 7,596,911 | B2 * | 10/2009 | Turco | 52/127.6 |
| 2002/0124514 | A1 * | 9/2002 | Higgins | 52/506.06 |
| 2002/0178554 | A1 * | 12/2002 | Salice | 24/457 |
| 2004/0172904 | A1 * | 9/2004 | Martensson | 52/384 |

* cited by examiner

*Primary Examiner* — Robert Canfield
*Assistant Examiner* — Matthew Gitlin
(74) *Attorney, Agent, or Firm* — Moss & Barnett

(57) ABSTRACT

The present invention is a wall panel assembly for securing a protective and/or decorative panel to a wall, such as the exterior wall of a building. The panel includes a rail and channel arrangement along each edge of the panel designed to slideably engage panel clips having a cooperative guide rail and channel. The clips are used to secure the panel to a wall using common fasteners, such as screws.

17 Claims, 10 Drawing Sheets

WALL PANEL ASSEMBLY

FIELD OF THE INVENTION

The present invention relates to decorative and/or protective wall panels for covering interior and exterior building walls and columns.

BACKGROUND OF THE INVENTION

There are many known arrangements for securing decorative and/or protective panels to an interior or exterior building wall or column.

U.S. Pat. No. 6,631,589 to Friedman et al. discloses the use of a first set of mounting brackets secured to a wall and a second set of mounting brackets secured to the back of a panel. When the panel is raised in front of the wall brackets for mounting, neither the first or second set of brackets can readily be seen, making alignment of the brackets and mounting of the panel more difficult. Further, two sets of brackets must be used to hang the panel, increasing the amount of time and hardware required to mount the panels. U.S. Pat. No. 2,653,686 to A. Routt provides a similar design of dual brackets, a first bracket mounted to the wall and a second bracket mounted to the back of the panel.

U.S. Pat. No. 3,282,004 to M. J. Brounn discloses an upper and lower bracket that attach to the top and bottom of a panel, respectively. The lower bracket is first mounted on the wall and is partially hidden when a panel is being mounted on the lower bracket.

U.S. Pat. No. 2,251,991 in favor of A. E. Fellner includes a fastener secured to a wall and a clip secured to the panel. The clip is designed to be mounted on the fastener to secure the panel to the wall.

U.S. Pat. No. 3,759,007 to Thiele discloses a joint assembly used to secure adjoining panels together. Each panel includes opposed male and female ends that engage corresponding ends of an adjoining panel to secure the panels in side by side relation.

U.S. Pat. No. 3,438,168 discloses the use of a clip, a first end of which engages a U-shaped lip running along a side of a panel. A second end of the clip engages flanges secured to a wall in order to secure the panel to the wall.

U.S. Pat. No. 3,388,518 to H. D. Scott discloses a panel clip, a first end of which engages a flange extending outwardly from a side of a panel.

U.S. Pat. No. 2,379,269 to W. A. Barrows discloses a fastener having a base and a series of tongues or fingers (three shown) extending substantially perpendicular from one end of the clip base to engage a panel flange. The base of the clip is then secured to a wall to secure the panel in place. Of the three tongues, the intermediate tongue is spaced from the adjacent tongues by a distance approximating the thickness of a panel flange. The clip is mounted on the panel with the panel flange positioned intermediate the spaced tongues. The panel will remain connected to the clip by the frictional grasp of the tongues. A sharp pointed projection may be carried on the tongues to engage the panel to enhance the frictional grip of the tongues. The clips are mounted to the panel flange by pressing the clip onto the panel flange with the panel flange intermediate the spaced tongues. The outer free ends of the tongues are bent to provide a throat to facilitate entry of the panel flange into the space between the spaced tongues. Although the engagement between the panel and clip may be substantial, the panels can be separated from the clips (and wall) by application of a disengaging force.

Panels secured to the exterior of buildings, particularly tall buildings, pose a threat to persons and property below if they were to come loose from the building. There is a need for a panel arrangement where panels can be easily and quickly mounted to a building wall and will remain secured in place once mounted, resistant to outside influences, such as wind or ice. There is also a need to provide a multitude of points at which a mounting clip can be secured to a panel.

SUMMARY OF THE INVENTION

The present invention is a specially designed panel and clip arrangement for mounting a panel to a building wall or column. The clip of the present invention is easily slidably mounted on the panel at a limited number of mounting locations located along the peripheral edge of the panel, typically one or more corners of the panel. Once the clip is mounted on the panel, the clip can be inseparably slid along the periphery of the panel until it reaches another mounting point. This prevents accidental separation of the clip and panel. Further, the clip may be slid along the panel to a desired location for optimally securing the panel to a wall.

One preferred embodiment of the panel of the present invention is a generally rectangular pan with sides extending rearward from a front surface of the panel. Running the length of the peripheral edges of each side is a rail. Adjacent to and coextensive with the rail is a channel. The rail and channel are designed to inseparably slideably engage a corresponding channel and rail on the panel clip.

The panel sides form side corners. Sections of the corners of the panel are removed so that at such corners of the panel, a clip can be slideably mounted to the peripheral edge of a panel side. The clip can only be mounted or removed from engagement with the panel sides at the corners of the panel in this embodiment.

The clip includes a fastening leg, a track leg and a restraining leg. The clip is fastened to a wall by the fastening leg. The track leg extends substantially perpendicular from one end of the fastening leg and includes a rail and channel arrangement designed to cooperatively engage the corresponding channel and rail arrangement of the side panel in sliding relation. Once the clip is mounted to the panel, the restraining leg prevents separation of the clip from the panel, maintaining the clip and panel in sliding interlocking relation.

The clips are always visible in the mounting process and may be secured to a wall before or after being mounted to the panel. When the clips are mounted to the panel, the fastening leg of the clip extends outward from the panel for easy access when securing the clip to the wall. The clip can easily be adjusted to a desired location along the panel sides by sliding the clip on the panel sides to the desired location.

Various decorative and protective covers or surfaces may be secured to or provided on the front of the panel as desired.

BRIEF DESCRIPTION OF THE DRAWINGS

Referring now to the drawings, wherein like reference numerals indicate corresponding structure through the several views.

DETAILED DESCRIPTION OF THE PREFERRED EMBODIMENT

Even though numerous characteristics and advantages of the present invention have been set forth in the following description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

Figure 1:
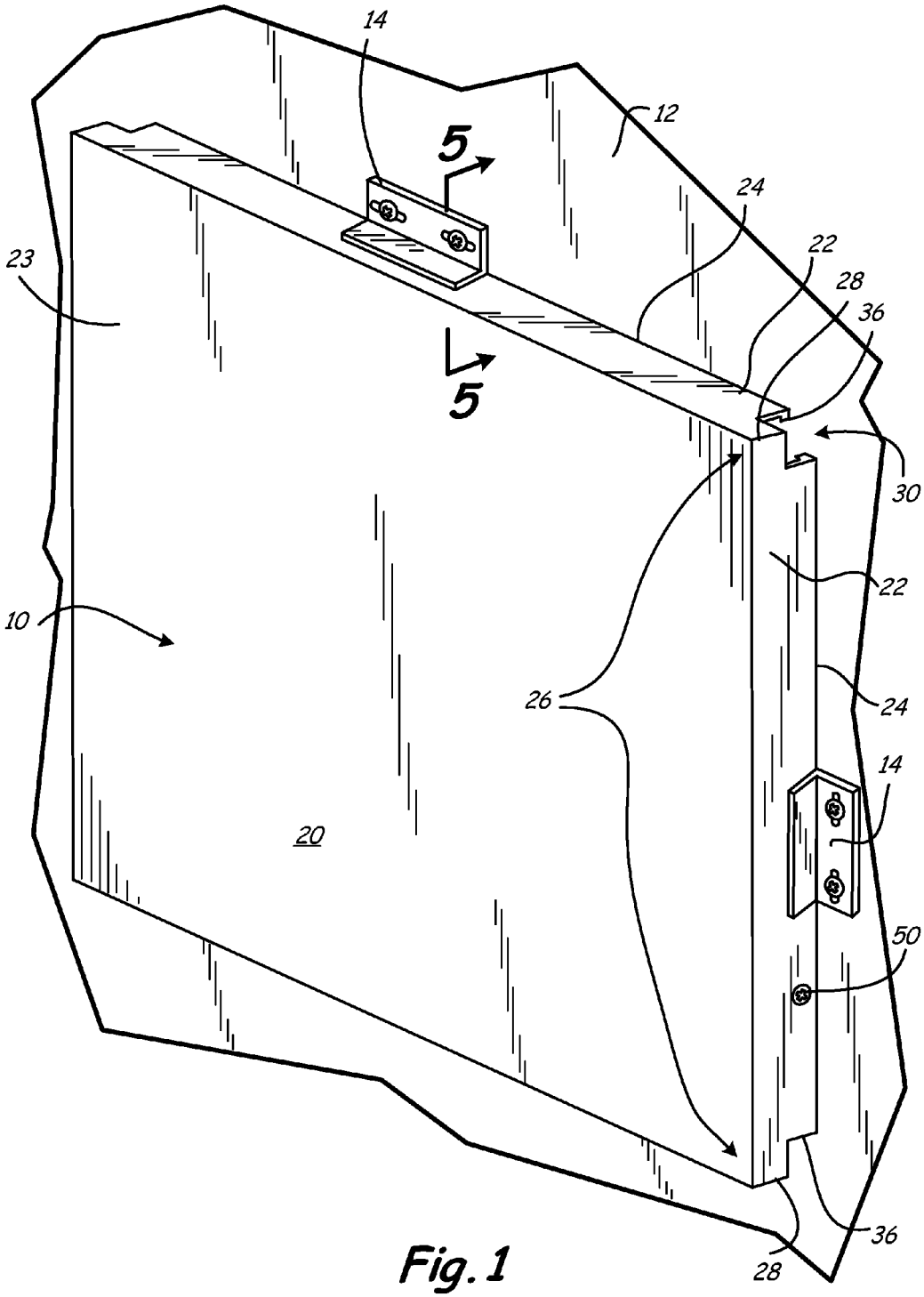
FIG. 1 is a perspective view of a first preferred embodiment of a panel secured by a first embodiment of a panel clip to a wall.

The present invention provides a method and structure for securing decorative and/or protective panels 10 to a wall 12 by panel clips 14 as shown in FIG. 1. The wall may be an interior or exterior wall or column or other suitable substrate for the panels. The means for fastening the panel clip 14 to the wall 12 may be fasteners of any suitable type, but for the purposes of illustration, common screws are referenced in this disclosure.

The panel may be of any shape or configuration, by way of example, rectangular, triangular or circular, and may have no sides or one or more sides, such as two sides on opposite sides of the panel. For illustrative purposes, the panel is generally described herein as having a rectangular pan shape with four sides.

As shown in FIG. 1, Panel 10 has a generally rectangular pan or tray shape with a front panel 20 and four sides 22 extending substantially perpendicular and rearward from the front or forward surface 23 of the front panel 20. The front surface 23 may include a decorative or protective surface.

Each side panel 22 has a peripheral edge 24 that faces the wall 12 when the panel 10 is mounted to the wall 12. Where two sides 22 meet at each corner 26 of the front panel 20 they form a side corner edge 28. A section at each longitudinal end of each side panel 22 is cut out to form an opening for mounting the panel clip 14 to the sides 22. Each cutout 30 is generally square or rectangular in shape (although other configurations are possible) and extend from the peripheral edge 24 of a side panel 22, up the side panel corner edge 28 for a distance, then towards the opposite end of the side panel for a distance, then back down to the peripheral edge 26, as shown in FIG. 1. The cutouts 30 are sized to permit panel clips to be secured to either of adjoining sides 22. The panel clips are mountable to the sides 22 from a leading edge 38 at each longitudinal end of each side panel 22.

Figure 2:
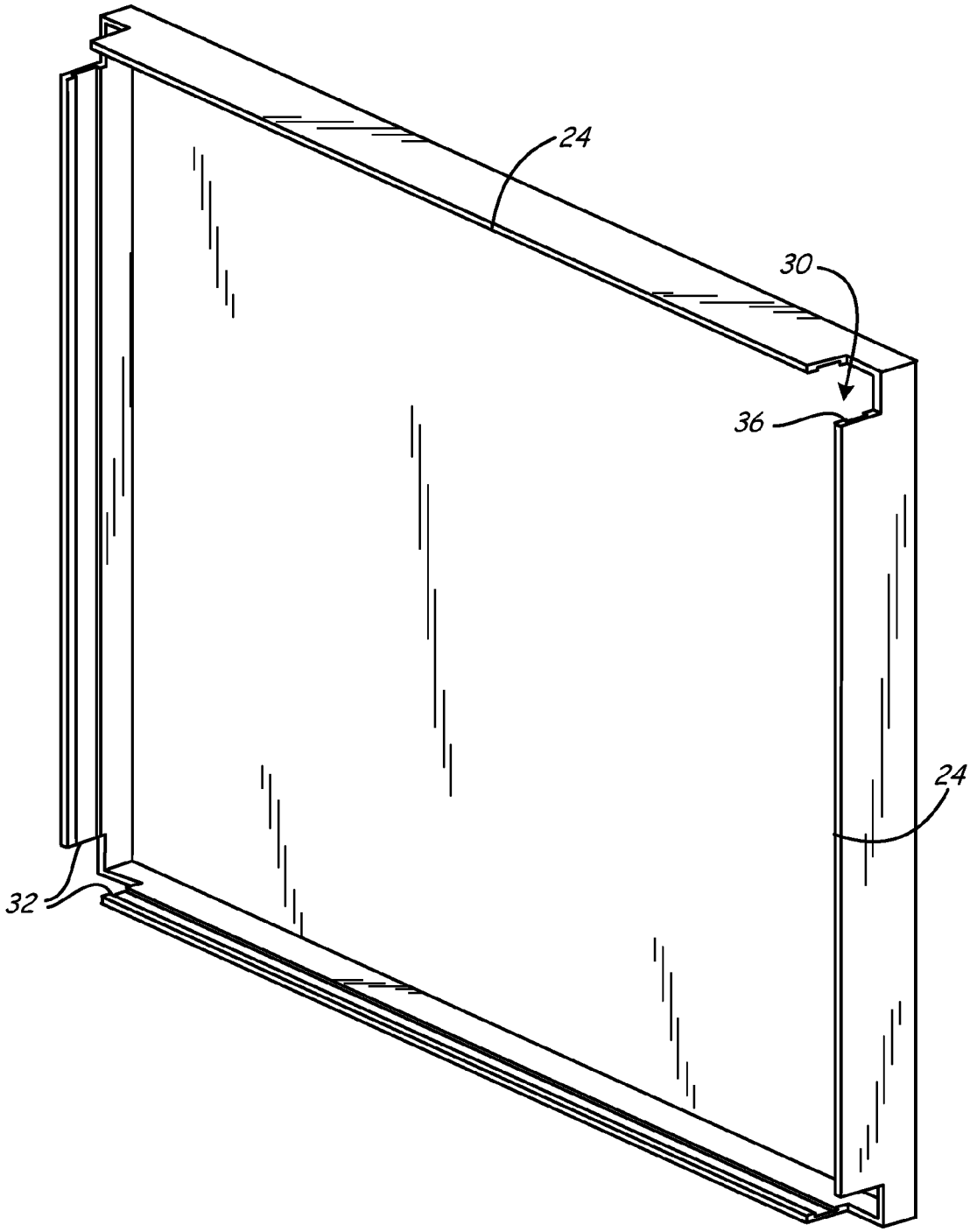
FIG. 2 is a perspective view of the a side of the panel opposite that shown in FIG. 1.
Figure 3:
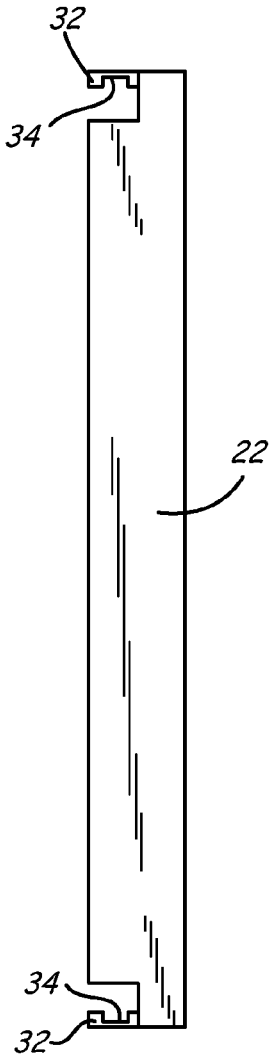
FIG. 3 is a side view of the panel shown in FIG. 1.

FIGS. 2 and 3 show a panel guide rail 32 defined along each peripheral edge 24 of each side panel 22. Between the guide rail 32 and the fastening leg 14 is formed a panel guide channel 34. Guide channel 34 is adjacent and coextensive with the guide rail 32. Guide channel 34 and rail 32 are designed to cooperatively engage a corresponding channel and guide rail on the panel clip 14 so that the panel clips 14 and panel sides 22 will be interlocked in sliding engagement.

Figure 4:
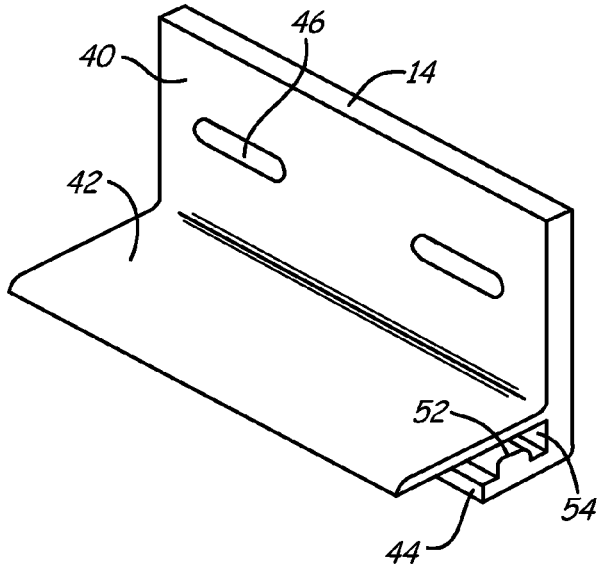
FIG. 4 is a perspective view of a first preferred embodiment of the panel clip.

FIG. 4 shows a perspective view of panel clip 14. Panel clip 14 includes a fastening leg 40, a restraining leg 42 and a track leg 44. The track leg 44 extends from a first end 45 of the fastening leg 40, generally perpendicularly to the plane of the fastening leg 40. The restraining leg 42 extends substantially perpendicular from the plane of the fastening leg 40 and parallel to and in spaced relation from the track leg 44.

Elongated openings 46 are defined in the fastening leg to accommodate screws or other fasteners to secure the panel clip 14 to wall 12. The elongated openings allow limited movement of the clip with respect to the screw fasteners when panel 10 is secured to the wall 12 in the event of expansion or contraction of the panel 10.

Figure 5:
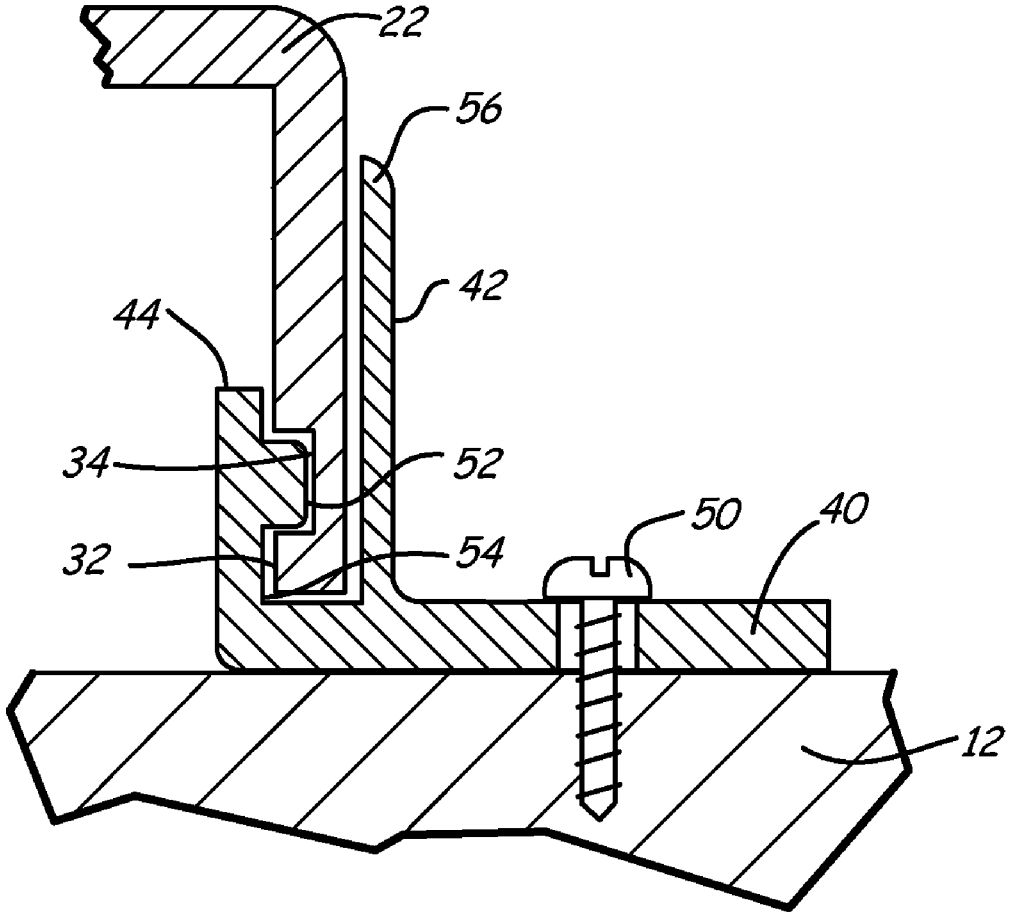
FIG. 5 is an end view of a clip mounted on the outer edge of a side of the first preferred embodiment of the panel.

FIG. 5 shows a partial sectional view of the panel clip 14 in FIG. 1 mounted on side panel 22. The panel clip 14 is shown secured to the wall 12 by a screw 50. The screw 50 extends though one of the elongated openings 46 in the panel clip 14 into the wall 12.

A clip guide rail 52 runs the length of the peripheral edge of the track leg 44 as shown in FIG. 5. A clip guide channel 54 is located adjacent and coextensive with the clip rail guide 52. The clip guide rail 52 and the side panel guide channel 34, and the clip channel 54 and the side panel guide rail 32, are designed to mate and cooperate with each other so that one or more clips 14 can be slideably mounted on one or more of the side panels 22. Restraining leg 42 on clip 14 is spaced from the track leg 44 slightly more than the thickness of the panel sides 22 to permit sliding movement between the panel clip 14 and the sides 22 but to prevent disengagement of the panel clip 14 from the panel sides 22. Once the clip 14 and panel 10 are slideably mounted together in interlocking relation, they cannot be separated except at the mounting openings located at the side corners 28 of each panel side 22. Restraining leg 42 also has a tapered end 56 for cosmetic purposes and to prevent injury to a person mounting the panels. Although the panel guide rail 32 and channel 34 and the clip guide rail 52 and channel 54 are shown as having a substantially square cross-section, other configurations can be utilized, such as rectangular or semicircular, so long as the cross-sectional arrangements prevent the panel 10 and clip 14 from separating except at the mounting locations on the panel 10.

Figure 6:
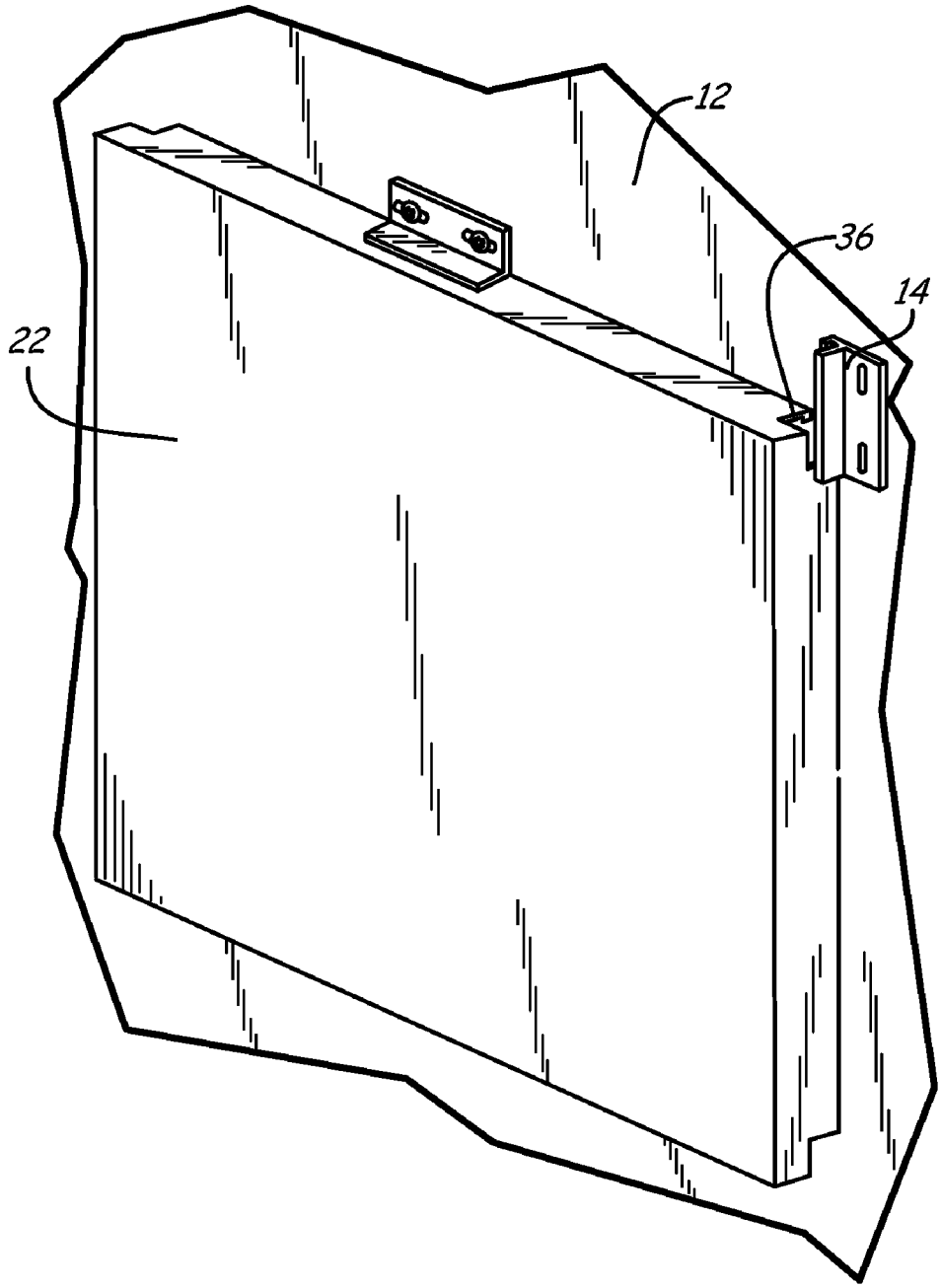
FIG. 6 is a perspective view of a partially mounted panel illustrating the mounting of a clip to a first preferred embodiment of the panel.

A panel clip 14 is mounted on a side panel 22 by longitudinally aligning the channel 54 and rail 52 of clip 14 with a corresponding rail 32 and channel 34 of a panel side 22 at a leading edge 36 of the side panel 22 and sliding the clip into engagement with the panel 22 as shown in FIG. 6. The guide leg 44 is positioned on the inside of the panel sides 22 and the restraining leg is positioned on the outside of side panels 22 to prevent the clip 14 from coming off the side panels 22. Once clip 14 is mounted on panel 22 (or vise versa), the clip 14 and panel 10 are in inseparable, interlocking, sliding relation and can only be disconnected at the corners 28 of the side panels 22 where the channel and rail arrangement of the side panel 22 is interrupted. This interlocking relation also makes it easier to handle both the clip 14 and panel 10 as the panel 10 is being mounted to wall 12. If desired, a stop, such as a screw secured through one of the panel sides 22 as shown at 50 in FIG. 1, can be used to limit movement of the clip 14 once mounted on the side panels 22. This is useful if a number of clips 14 are slideably mounted on the side panels 22 before the panel 10 is mounted on a wall 12. The stops will prevent the clips 14 from sliding off the side panels 22 as the panel 10 is moved into place.

Figure 12:
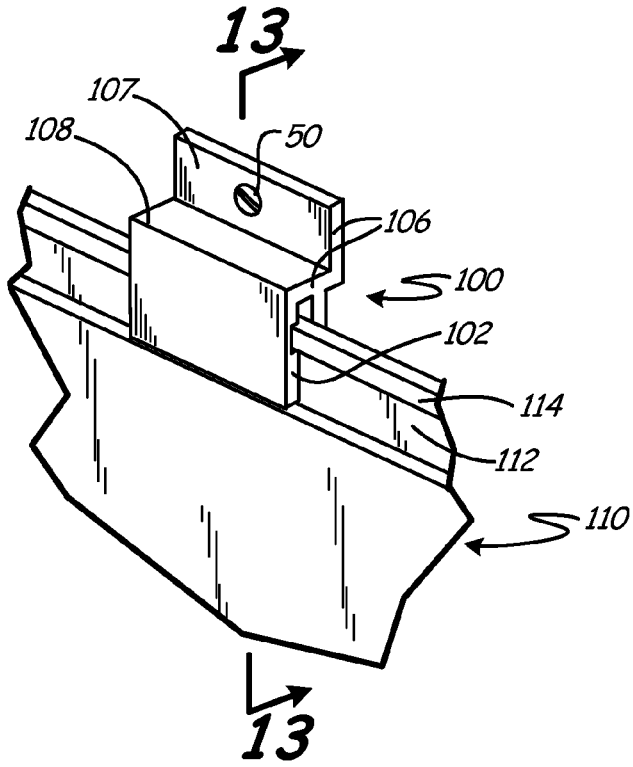
FIG. 12 is a partial perspective view of another preferred embodiment of a panel having no sides with a mounting clip slideably secured to its peripheral edge.
Figure 13:
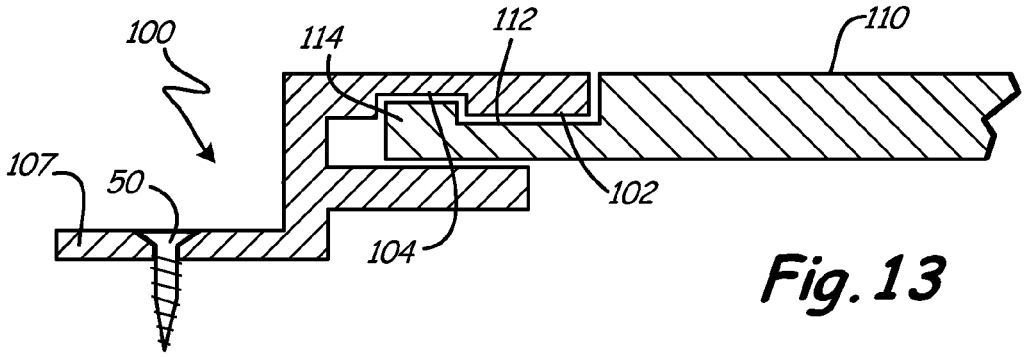
FIG. 13 is a partial sectional view of the panel and clip of FIG. 12 illustrating the inseparable sliding arrangement of the clip and panel.

As illustrated in FIG. 12, clip 100 is mounted to panel 110 which has no sides. Clip 100 includes a guide rail 102 of rectangular cross section and a channel 104 that slidably and cooperatively mate with a channel 112 and guide rail 114 of panel 110 as shown. The fastening leg 106 has a generally "L" shape to support the panel 110 at a distance from wall 120. A first leg 107 is secured to wall 120 and a second leg 108 separates the panel 110 from the wall by a predetermined distance.

Figure 8:
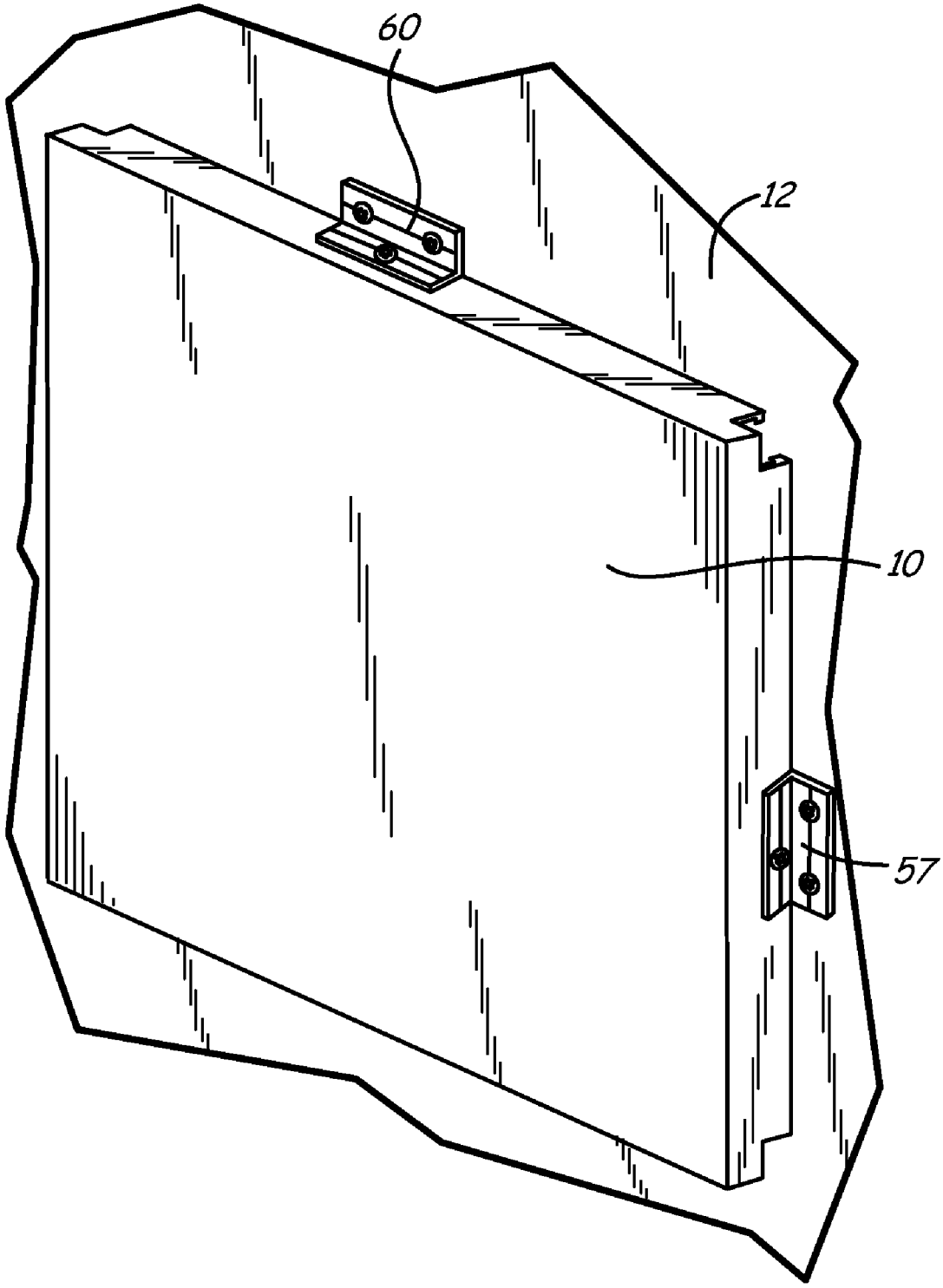
FIG. 8 is a perspective view of a first preferred embodiment of the panel secured to a wall by an alternate embodiment of a panel clip.
Figure 11:
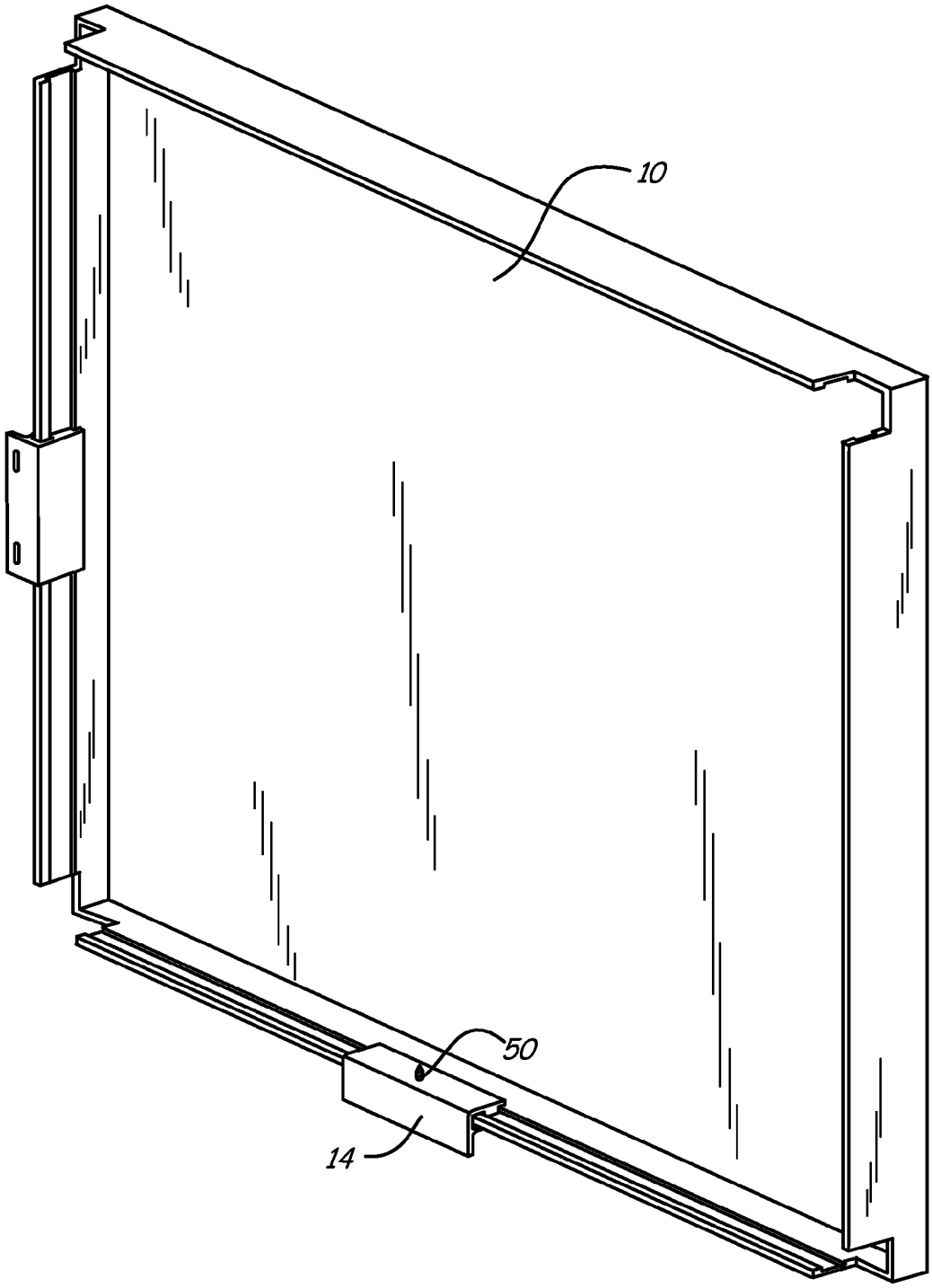
FIG. 11 is a perspective view of the back side of a first preferred embodiment of the panel illustrating how a clip can be fixed in place on the panel.

When mounting the panel 10, the clip is slid along the peripheral edge 24 of the side panel 22 until it reaches a desired location with respect to the panel 10. The panel clip 14 is then secured to the wall 12 to fix the panel clip 22 and the panel 10 to the wall 12. Alternatively, a panel clip 10 can first be secured to the wall 12 and the panel 10 can then be mounted on and slid along the panel clip to secure the panel 10 in place. Also, a screw 50 can be used to secure the clip 14 to the panel 10 as shown in FIGS. 8 and 11. This fixes the position of the panel with respect to the clip 14 and further secures the panel 10 to the wall 12.

If panels 10 are mounted to the wall 12 in side by side (vertical or horizontal) relation, a gap will exist between the panels. This gap is typically covered for cosmetic reasons as well as to protect the clip, panel, fastener and wall from the elements, such as wind and ice, or from tampering. Flexible material which can contract and expand as the panels 22 contract or expand is preferred. Such materials, for instance caulk, rubber or plastic, are well known in the industry.

Figure 7:
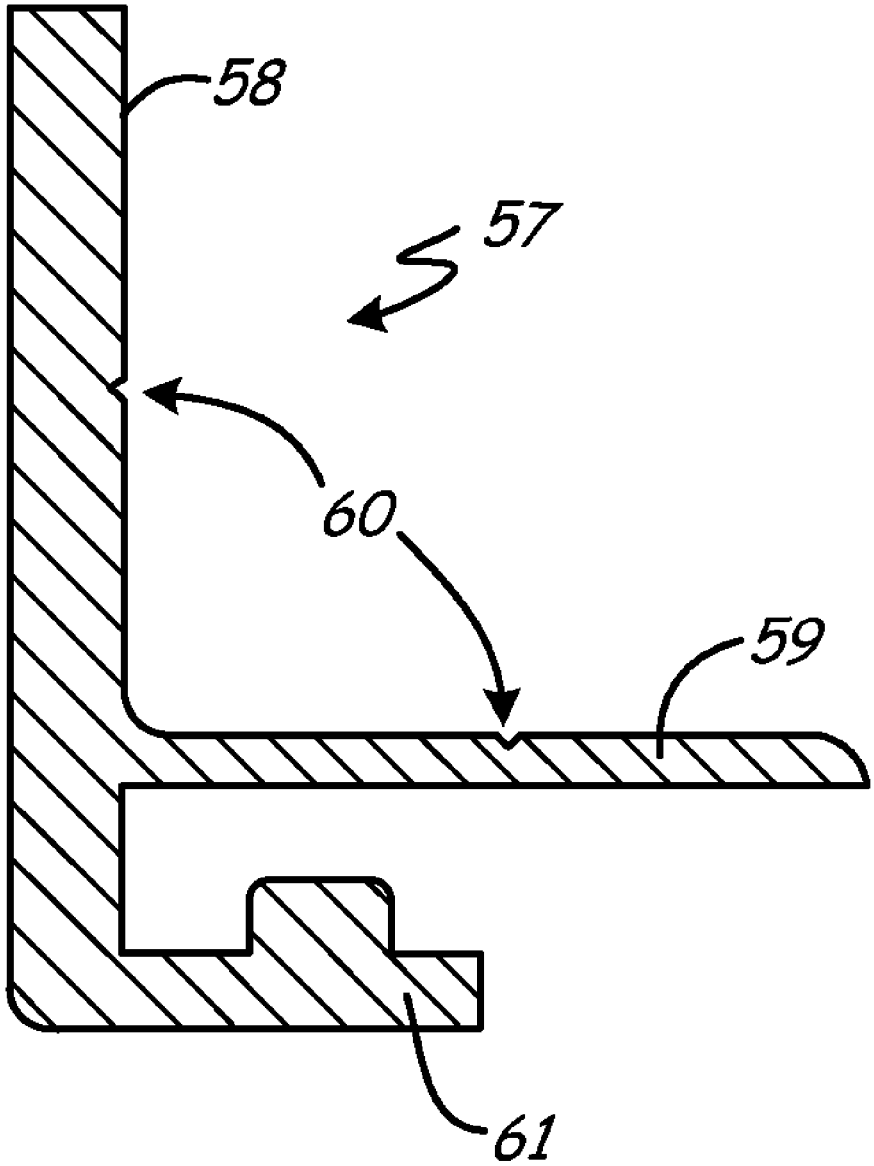
FIG. 7 is an end view of an alternate embodiment of a clip.

FIG. 7 shows an alternate embodiment of a panel clip 57. Panel clip 57 includes a fastening leg 58, a restraining leg 59 and a track leg 61. Additionally, panel clip 57 includes a groove or screw guide 60 defined along the length of the fastening leg 58 and the restraining leg 59. The screw guide is shown as being V-shaped in cross section, but may be of different cross-sectional shapes. The screw guide facilitates positioning of self-tapping screws when the panel clip 57 is secured both to the wall 12 and the panel 10 as shown in FIG. 8. Securing the clip 57 to both the wall 12 and the panel 10 secures the panel clip 57, the panel 10 and the wall 12 in place with respect to each other. Panel clip 57 can also be made with a screw guide 60 extending only partially along the length or width of the fastener leg 58 and/or restraining leg 59. Typically a panel clip will have either the screw guide 60 or the elongated openings 46 on a leg, but the restraining legs and fastening legs could have either elongated openings 46 or screw guides 60.

Figure 9:
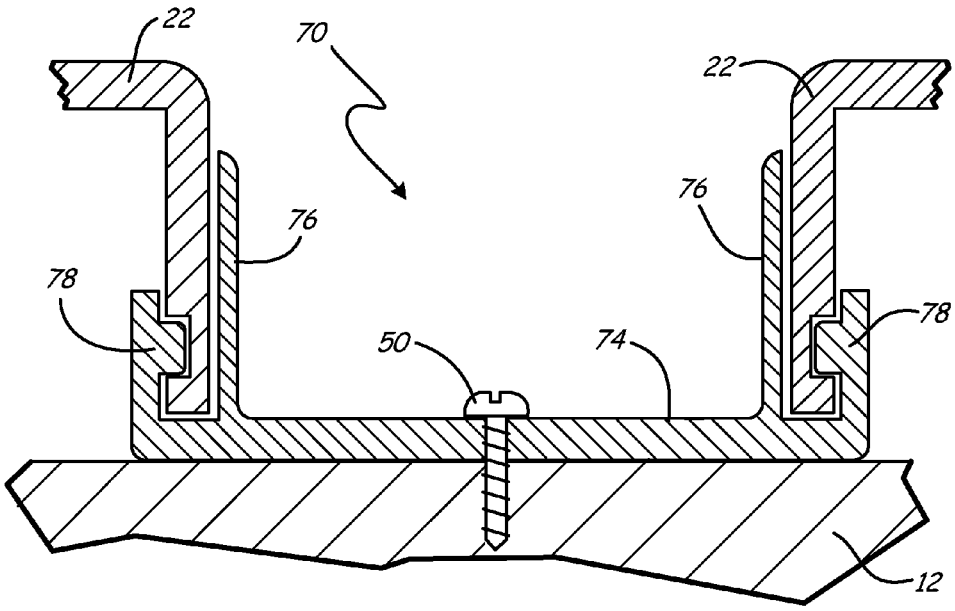
FIG. 9 is an end view of an alternate embodiment of a clip securing two panels to a wall in side-by-side relation.

FIG. 9 shows an alternate embodiment of the panel clip, a double clip 70. This "double clip" arrangement incorporates the functionality of two clips back to back so that one clip is capable of supporting two side by side panels 22. The double clip 70 includes one fastening leg 74, two restraining legs 76, and two track legs 78. The track legs 78 are positioned at opposite ends of the fastening leg 74 and extend generally perpendicular from the plane of the fastening leg 74. The track legs 78 include a rail and channel arrangement as with clip 14. The restraining legs 76 also extend generally perpendicular from the plane of the fastening leg 74 in spaced, generally parallel relation to an associated guide leg 78 to maintain contact between the rail and channel arrangement of the clip 70 and the channel and rail arrangement of the panel 10. This maintains an inseparable, sliding relationship between the clip 70 and panel sides 22.

The double clip 70 is secured to a wall 12 by screw 50 extending through the fastening leg 74. Double clips 70 are mounted to the wall 12 in spaced relation and panels 10 are then mounted to the double clip 70. Alternatively, the double clip 70 can be mounted at one end to a panel 22 and then be secured to a wall 12. A second panel 22 is then mounted to the opposite end of double clip 70. Double clip 70 can be made with elongated openings to receive screws or other fasteners or can be made with screw guides 60 on either or both of the fastening legs 74 and restraining legs 76.

Figure 10:
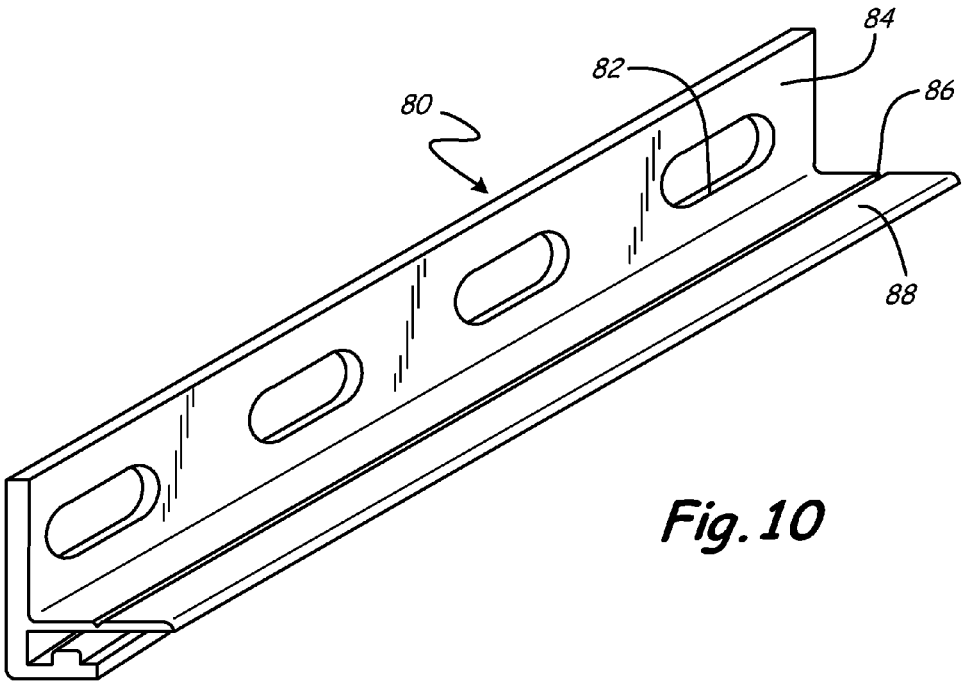
FIG. 10 is a perspective view of an alternate embodiment of a clip.

FIG. 10 shows yet another embodiment of a panel clip which is longer than panel clip 14 shown in FIG. 1. Panel clip 80 is designed to provide more fastening points when the panel clip 80 is secured to a wall. This embodiment of the panel clip 80 is shown with elongated holes 82 on the fastening leg 84 and a screw guide 86 on the restraining leg 88 although other arrangements are possible.

Although clips of various sizes may be utilized, ideally, the same sized clip will be used throughout a project. This avoids concerns that the wrong size clip was used and provides a uniform installation of the panels. Further, installation is quicker and easier if only a singe size of clip is used. It is also less expensive to make a single size of clip than to have to manufacture and use clips of different sizes.

The panel 10 and clip 14 of the present invention may be quickly assembled and secured to a wall 12. The present invention provides increased ease and speed of installation over the prior art. The clips 14 are movable along the entire length of each side of the panel 10 making it easier to locate an optimal position for securing the clip 14 to the wall 12 or the panels 10. For panels secured to a wall in side-by-side relation (vertical or horizontal), the clips 14 on each panel 10 may be placed in staggered position with respect to the clips 14 on the adjoining panel 10 to reduce the size of the gap or space between the panels 10. The clips 14 are always visible and accessible and readily secured to a wall 12 because the fastening leg 40 extends outward from panel 10.

The panel and clip should have compatible configurations to maintain their inseparable, interlocking relation. For panels having a rectangular or square configuration (linear panel edges), the clips may have a linear guide rail and channel to mate with a linear panel channel and guide rail. For panels having arcuate edges and arcuate guide rails and channels, the clips may have an arcuate channel and guide rail to properly mate with the panel.

What is claimed is:

1. A panel assembly comprising:

(a) a clip for supporting a panel on a substrate, the clip including a fastening leg for securing the clip to the substrate, a track leg extending substantially perpendicular from a first end of the fastening leg, which track leg includes a coextensive guide rail and channel for cooperatively engaging a corresponding-channel and guide rail on the panel, and a restraining leg extending substantially perpendicular from the fastening leg in spaced and substantially parallel relation to the track leg for maintaining inseparable sliding engagement between the clip guide rail and channel and the panel channel and guide rail;

(b) a panel having a front panel section and a panel side extending substantially perpendicular and rearward from the periphery of the front panel section, a guide rail and channel defined on and along the peripheral edge of the panel side with at least one interruption in the channel and rail for mounting the clip to the panel; wherein the side panel guide rail and channel correspond to and cooperate with a guide rail and channel carried by a clip to secure the clip and panel in inseparable sliding relation.

2. The panel of claim 1 wherein the rail and channel along the periphery of the panel have an arced configuration and the clip rail and channel have a similar arced configuration so that the clip can be inseparably slid along the curved peripheral edge of the panel.

3. A panel assembly including:

(a) a clip for supporting a panel on a substrate, the clip comprising:

(i) a fastening lea for securing the clip to the substrate;

(ii) a track leg extending substantially perpendicular from a first end of the fastening leg, which track leg includes a guide rail and an adjacent channel for cooperatively engaging a corresponding guide rail and channel located along a peripheral edge of a panel; and (iii) a restraining leg extending substantially perpendicular from the fastening leg in spaced and substantially parallel relation to the track leg for maintaining inseparable sliding engagement between the clip track leg rail and channel and the panel guide rail and channel once the clip is mounted on the panel; and (b) a panel including a guide rail extending along the peripheral edge of the entire panel and a channel adjacent to and coextensive with the guide rail, with at least one interruption in the guide rail and channel to create at least one location for connecting the panel guide rail and channel to the clip channel and guide rail in inseparable, sliding relation.

4. The panel assembly of claim 3 wherein the guide rail and channel are formed in the panels.

5. The panel assembly of claim 3 wherein the restraining leg and track leg of the clip are spaced from each other at a distance slightly more than the width of the side panels.

6. The panel assembly of claim 3 further comprising elongated openings on the fastening leg or restraining leg for receiving fasteners used to secure the clip to a wall.

7. The panel assembly of claim 3 further comprising grooves on the fastening leg or restraining leg for receiving self-tapping screws.

8. The panel assembly of claim 3 further comprising a fastener for fixedly securing the clip and the panel together to prevent movement of the panel with respect to the clip.

9. The panel assembly of claim 3 further including stop means for limiting movement of the clips on the panel.

10. The wall panel assembly of claim 3 wherein the panel includes two sides that extend rearward from opposite sides of the panel.

11. A panel assembly comprising:

(a) a panel including at least one side extending substantially perpendicular and rearward from the panel; a guide rail extending along each peripheral edge of each side of the panel; a channel coextensive with the guide rail; wherein the side panel guide rail and channel correspond to and cooperate with a guide rail a channel carried by a clip to secure the clip and panel in inseparable sliding relation;

(b) a clip for supporting a panel on a wall, the clip including a fastening leg for securing the clip to the wall; a track leg extending substantially perpendicular from a first end of the fastening leg, which track leg includes a guide rail and a channel located coextensive with the rail for cooperatively engaging the corresponding channel and guide rail on the panel; and a restraining leg extending substantially perpendicular from the fastening leg in spaced and substantially parallel relation to the track leg for maintaining inseparable sliding engagement between the clip guide rail and channel and the panel channel and guide rail.

12. The panel assembly of claim 11 wherein the panel has a rectangular configuration, four sides defining four panel side corners and the interruptions in the panel guide rail and channel are located at the peripheral edge of at least one side panel corner.

13. The panel assembly of claim 11 wherein the panel has a rectangular configuration, four sides defining four panel side corners and the interruptions in the panel guide rail and channel are located at the peripheral edge of each side panel corner.

14. A clip for mounting a panel on a substrate, the panel having a front panel section, a guide rail and channel coextensively extending along a peripheral edge of the panel with at least one interruption in the guide rail and channel to create a location for the clip to be secured in inseparable, sliding relationship with the panel, the clip including:

(a) a fastening leg for securing the clip to the substrate;

(b) a track leg extending substantially perpendicular from a first end of the fastening leg, which track leg includes a guide rail located along a peripheral edge of the track leg and a channel coextensive with the guide rail for cooperatively engaging the rail and channel defined on the periphery of the panel; and (c) a restraining leg extending substantially perpendicular from the fastening leg in spaced and substantially parallel relation to the track leg for maintaining interlocking sliding engagement between the clip guide rail and channel and the panel channel and guide rail.

15. The clip of claim 14 further including:

(a) a second track leg extending substantially perpendicular from a second end of the fastening leg, which second track leg includes a second guide rail and a second channel coextensive with the second guide rail for cooperatively engaging a corresponding second panel guide rail and channel in inseparable sliding relation; and (b) a second restraining leg extending substantially perpendicular from the second end of the fastening leg in spaced and substantially parallel relation to the second track leg for maintaining inseparable sliding engagement between the second guide rail and second channel and a second panel channel and guide rail.

16. A panel for covering a substrate for use with a clip having fastening leg for securing the clip to the substrate, a track leg extending substantially perpendicular from a first end of the fastening leg, which track leg includes a guide rail and a channel located coextensive with the rail for cooperatively engaging a corresponding channel and guide rail on the panel, and a restraining leg extending substantially perpendicular from the fastening leg in spaced and substantially parallel relation to the track leg for maintaining inseparable sliding engagement between the clip guide rail and channel and the panel channel and guide rail the panel including (a) a front panel section;

(b) a guide rail extending along the peripheral edge of the panel;

(c) a channel coextensive with the guide rail;

wherein there is at least one interruption in the guide rail and channel to create an opening for the clip to be secured in inseparable, sliding relationship to the panel.

17. The panel of claim 16 wherein the front panel section is generally rectangular and includes four sides extending substantially perpendicular and rearward from a front surface of the front panel section creating four side panel corners and the interruptions in the guide rail and channel are located at each corner of the front side panel.

* * * * *